United States Patent [19]

Berchem et al.

[11] Patent Number: 4,769,886

[45] Date of Patent: Sep. 13, 1988

[54] CONCRETE REINFORCING ELEMENT AND METHOD OF MAKING A CONCRETE REINFORCEMENT

[75] Inventors: Rütger Berchem; Wolf-Rüdiger Linder, both of Essen, Fed. Rep. of Germany

[73] Assignee: Berchem & Schaberg GmbH, Gelsenkirchen, Fed. Rep. of Germany

[21] Appl. No.: 679,733

[22] Filed: Dec. 10, 1984

[30] Foreign Application Priority Data

Dec. 10, 1983 [DE] Fed. Rep. of Germany ..... 3344775

[51] Int. Cl.[4] ..... B23P 17/00

[52] U.S. Cl. ..... 29/155 R; 29/452; 29/460; 264/228; 148/14; 148/136; 148/137; 148/143; 148/144

[58] Field of Search ..... 264/228; 52/736; 148/14, 136, 137, 143, 144; 219/146.23, 162; 29/DIG. 49, DIG. 48, DIG. 42, DIG. 38, DIG. 29, DIG. 25, DIG. 5, DIG. 4, 155 R, 452, 460

[56] References Cited

U.S. PATENT DOCUMENTS

| | | | |
|---|---|---|---|
| 1,770,932 | 7/1930 | Leake | 29/DIG. 42 |
| 2,350,532 | 6/1944 | Richardson | 148/144 |
| 2,709,145 | 5/1955 | Bucknall | 148/14 |
| 3,041,702 | 7/1962 | Schwab | 264/228 |
| 3,086,273 | 4/1963 | Welborn | 264/228 |
| 3,123,469 | 3/1964 | Tanczyn | 148/136 |
| 4,051,216 | 9/1977 | Bratchell | 264/228 |
| 4,125,580 | 11/1978 | Lippert | 264/228 |
| 4,321,098 | 3/1982 | Hayden | 148/14 |

*Primary Examiner*—Jan H. Silbaugh
*Assistant Examiner*—Hubert C. Lorin
*Attorney, Agent, or Firm*—Herbert Dubno

[57] ABSTRACT

Tensioning elements for construction purposes comprising reinforcing rod for prestressing concrete can be fabricated from steel of the following composition:

0.7 to 1.0% by weight Mn
0.7 to 2.2% by weight Cr
0.3 to 0.6% by weight Mo
0.5 to 2.2% by weight Ni
up to 0.45% by weight C (preferably at least 0.1% by weight C.)
balance iron and unavoidable steel impurities which is subjected to austenitization, oil quenching and optional tempering to a tensile strength of 1400 to 2000 $N/mm^2$ and an elongation to break in excess of 7% and preferably about 10% and is welded to a terminal element of the same composition but having a tensile strength substantially 10–20% less than that of the rod, and then incorporated into a concrete structure.

4 Claims, 1 Drawing Sheet

CONCRETE REINFORCING ELEMENT AND METHOD OF MAKING A CONCRETE REINFORCEMENT

FIELD OF THE INVENTION

Our present invention relates to improvements in concrete prestressing reinforcements, more particularly, to improved concrete pretensioning reinforcing elements, a method of making such elements and a method of reinforcing and pretensioning concrete structures utilizing the improved pretensioning elements of this invention.

BACKGROUND OF THE INVENTION

The construction field makes use of elongated steel elements in the form of rods, bars, wire and cable for applying a prestress in a structural element or for a capacity to take up a continuous tensile stress applied thereto and it is with such elements, whether they are used in prestressed reinforced concrete or simply for tensioning members for bridges and other suspended structures, that the present invention is concerned.

Conventional steel pretensioning or prestressing elements are composed of steel alloys with approximately the following composition:

- 0.7 to 0.9% by weight carbon
- 0.1 to 0.3% by weight silicon
- 0.5 to 0.9% by weight manganese
- balance iron and unavoidable impurities and associated elements which do not affect the properties of the composition.

Such steels are used as concrete reinforcing steels in accordance with the German industrial standard DIN 4227, for example, having a tensile strength in the range of 1000 N/mm$^2$ to 1600 N/mm$^2$. The yield point is generally about 15% lower and both tensile strength and yield point, as well as elongation to break and the necking in characteristics at break generally have been found to be lacking as will be discussed below. For example, the elongation to break is usually a maximum of 7%, but generally is well below this level. The conventional pretensioning elements composed of such steels conforming to these standards have been found to be unusually sensitive to handling and emplacement operations and to anticorrosion techniques which have been used, and to have problems with respect to welding.

The indicated tensile strength is generated primarily by a cold working using cold rolling and stretching or drawing and these techniques are used, for example, in the fabrication of so-called ribbed re-bar, i.e. concrete reinforcing bars or rods which are rolled with ribs intended to promote gripping by the concrete.

The cold working and the alloy composition appear to result in a product which cannot be welded without serious loss of tensile strength and other properties, especially at the building location at which the element is to be used without pretreatment or extremely expensive techniques for providing elements of more weldable materials between the less weldable or more sensitive reinforcing elements. Finally we may note that these elements have very poor corrosion resistance.

OBJECTS OF THE INVENTION

It is, therefore, the principal object of the present invention to provide improved concrete pretensioning and reinforcing elements which obviate the disadvantages outlined above, more particularly can be less sensitive to the operations usually used in construction, can be used under conditions which require tensile strengths of up to 2000 N/mm$^2$ and will have improved weldability and corrosion resistance while also having a more satisfactory yield point and elongation to break.

Another object of this invention is to provide an improved prestressed concrete structure utilizing the important reinforcing and pretensioning elements of the present invention; yet another object of our invention is to provide an improved method of making a prestressed concrete structure.

It is also an object of this invention to provide an improved method of making concrete pretensioning and prestressing elements.

SUMMARY OF THE INVENTION

Our invention is based upon our discovery that a conventional steel composition which has not, to our knowledge, been used heretofore for prestressed concrete reinforcing elements, upon fabrication into such elements can eliminate all of the problems outlined above and greatly improve the operations of prestressing concrete and, because of improved weldability, corrosion resistance and tensile strength, can simplify such construction and provide long-lasting high-strength structures in a more reliable and effective manner than has heretofore been the case.

According to the invention, the pretensioning elements are constituted of a steel having the following composition:

- 0.7 to 1.0% by weight Mn
- 0.7 to 2.2% by weight Cr
- 0.3 to 0.6% by weight Mo
- 0.5 to 2.2% by weight Ni
- up to 0.45% by weight C (preferably at least 0.1% by weight C)
- balance iron and unavoidable steel impurities.

According to the invention, this steel is formed into pretensioning or prestressing elements, e.g. for concrete in the form of reinforcing rod or bars, tensioning wires or tensioning cables (multiwire standards) so that they can be used in applications in accordance with standards whereby they may be subjected to tensile stresses up to at least 1700 N/mm$^2$.

The material is heat-treated so that it will have a tensile strength in the range of 1400 N/mm$^2$ to 2000 N/mm$^2$, and an elongation to break in excess of 7%.

The steel composition used is a conventional manganese-chromium-molybdenum-nickel steel utilized for forging of machine parts. According to a feature of the invention, the elements are heat-treated in a series of steps involving initially austenitization (heating to the austenitization temperature), quenching in oil and, if desired, tempering to the requisite tensile strength.

We have found that this will yield products with an elongation to break of about 10%.

When the elements are in the form of re-bar, they can have diameters from 5 to 40 mm, preferably 8 to 36 mm in accordance with the invention, usually will be ribbed, and can be utilized in concrete pretensioning and reinforcement individually or in bundles. However, the invention is also applicable to tensioning wires or cables, the individual wires having diameters of 1 mm and more. The wires can be used as suspension cables in bridges, as truss hangers from suspension cables, and in general in any application where the wires are required to take up substantial tensile forces over prolonged periods.

When the elements are used as the pretensioning or prestressing elements in concrete, it is advantageous to provide them with special devices or members which can be used to generate the prestress. In this case the members may be formed as terminals and the reinforcing elements which are composed of the same material but have been subjected to a heat treatment such that their tensile strengths are about 10 to 20% lower than those of the reinforcing elements to which they are secured.

BRIEF DESCRIPTION OF THE DRAWING

The above and other objects, features and advantages of the present invention will become more readily apparaent from the following description, reference being made to the accompanying drawing in which:

FIG. 3 is an elevational view of a section of cable for use as a suspension, e.g. in bridges or the like.

SPECIFIC DESCRIPTION AND EXAMPLE

Figure 1:
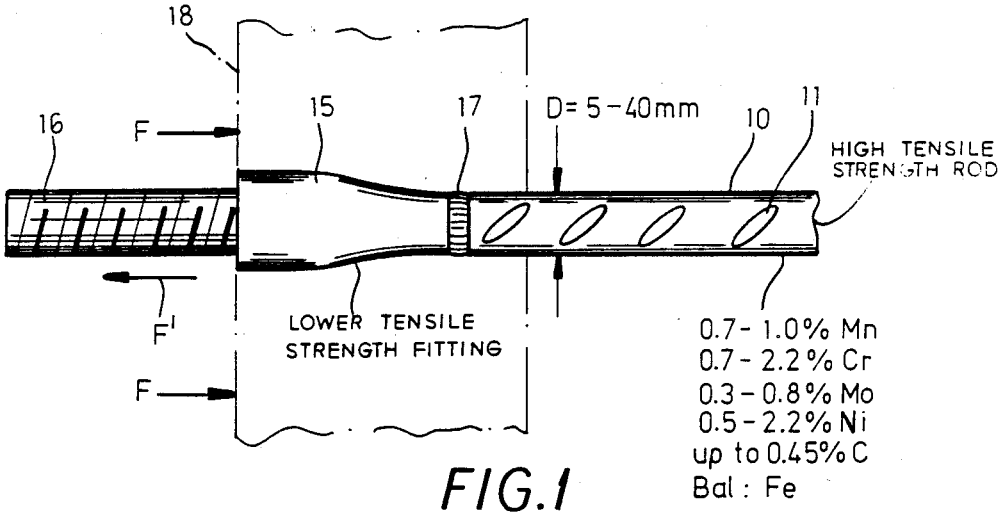
FIG. 1 is an elevational view showing an end of a re-bar in accordance with the invention provided with a terminal member for the prestressing of a concrete body in which re-bar is anchored and which has been shown in dot-dash lines.

The reinforcing bar 10 illustrated in FIG. 1 is shown to be provided with diagonal ribs 11 which can be formed in a rolling operation following casting of the billet from a steel within the composition indicated and set forth above in accordance with the invention.

By way of example, the steel had a manganese content of 0.85% by weight, a chronmum content of about 1.1% by weight, a molybdenum content of about 0.55% by weight, a nickel content of about 1.1% by weight and a carbon content of 0.35% by weight, balance iron.

Figure 4:
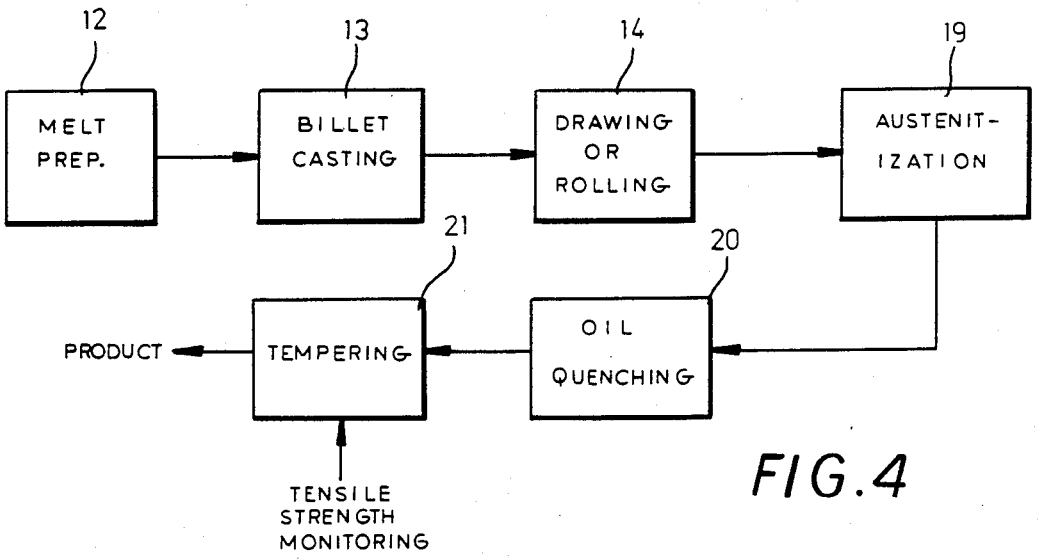
FIG. 4 is a diagram illustrating the method of this invention.

Referring to FIG. 4, after the melt formed by these components was prepared at 12, a billet 13 was cast and subjected to hot rolling at 14 to form the reinforcing element 10. The product is then austenitized at a temperature of about 890° C., quenching in oil and then tempered to a tensile strength of about 1850 N/mm$^2$ and elongation to break of about 10%. Utilizing the same composition, but with a tensile strength of about 1600 N/mm$^2$, a member 15 is provided with a thread 16 welded at 17 to the reinforcing element 11 so that, with conventional prestressing nuts and the like, the member can be braced against the concrete body 18 with a force F while a corresponding tensile stress is applied to the element in the direction of arrow F'. The austenitization, oil quenching and tempering steps have been represented respectively at 19, 20 and 21 in FIG. 1.

Figure 2:
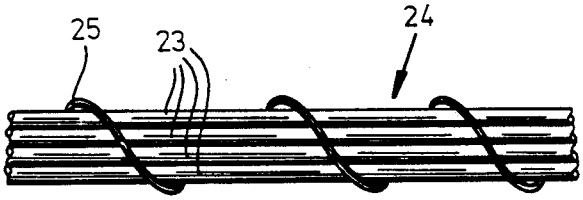
FIG. 2 illustrates a reinforcing unit for concrete which comprises a re-bar bundle composed of the reinforcing elements of this invention.
Figure 3:
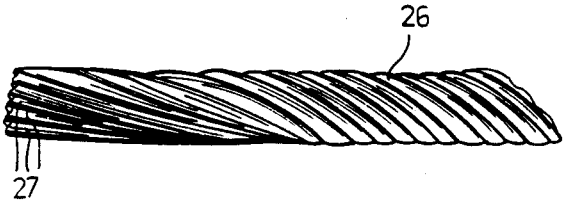

In FIG. 2 it will be apparent that a plurality of reinforcing rods or bars 23 can be held together by a wire 25 although tack welds can be used to assemble the bars of the bundle here as well. The invention is also applicable to a cable 26 formed from individual wires 27 produced in the manner described and from the new composition of this invention.

The advantages of the present invention not only include the increased tensile strength resulting from the heat treatment of the composition of the invention but also in the general improvement of the properties of the reinforcing elements which have thus been made. The elongation to break exceeds 7%. Perhaps the most surprising fact is that in spite of the increased tensile strength and elongation to break, the reinforcing element is also weldable and this has been achieved without significant increase in cost so that welding of the elements can also be effected at the building location in which the element is to be used.

In addition the corrosion rate of the elements of the invention are greatly reduced by comparison with conventional reinforcing bars and tensioning wires.

Nevertheless one can also use conventional anticorrosion and welding techniques. The products have been found to be capable of withstanding at least tensile stresses of 1770 N/mm$^2$ in application. Furthermore, as a general matter because of the improved tensile strength and ductility, the allowable tensile strength to which the elements can be subjected can be even 5 to 10% higher than the ratings given above. Special handling procedures are not required for the elements of the invention.

We claim:

1. A process for making a concrete reinforcement, comprising the steps of:

forming a reinforcing element having a composition consisting essentially of:

0.7 to 1.0% by weight manganese
0.7 to 2.2% by weight chromium,
0.3 to 0.6% by weight molybdenum,
0.5 to 2.2% by weight nickel,
up to 0.45 by weight carbon and
balance iron and unavoidable steel impurities; and drawing or rolling said reinforcing element, heating said element initially to an austenitization temperature, quenching said element; and tempering said reinforcing element to a tensile strength of substantially 1400 N/mm$^2$ to 2000 N/mm$^2$ and an elongation to break of at least 10%;

forming a terminal member with a threaded end and an end to be welded having said composition, heat treating said member to a tensile strength substantially 10 to 20% less than that of said reinforcing element, welding said reinforcing element to the end to be welded of said terminal member for forming the concrete reinforcement; and incorporating said element in a concrete structure.

2. The process defined in claim 1 wherein said reinforcing element is formed as being a ribbed rod.

3. The process defined in claim 2 wherein said reinforcing element is formed as a wire.

4. The process defined in claim 3 wherein said wire is formed with a diameter of at least 1 mm.

* * * * *